US011342104B2

(12) United States Patent
Gwadera et al.

(10) Patent No.: US 11,342,104 B2
(45) Date of Patent: May 24, 2022

(54) INDUCTOR ARRANGEMENT COMPRISING AN INSERT

(71) Applicant: SMA Solar Technology AG, Niestetal (DE)

(72) Inventors: Mariusz Gwadera, Cracow (PL); Jakub Hachlowski, Skawina (PL); Mariusz Walczak, Cracow (PL); Zajac Tomasz, Karniowice (PL)

(73) Assignee: SMA Solar Technology AG, Niestetal (DE)

( * ) Notice: Subject to any disclaimer, the term of this patent is extended or adjusted under 35 U.S.C. 154(b) by 756 days.

(21) Appl. No.: 16/171,866

(22) Filed: Oct. 26, 2018

(65) Prior Publication Data

US 2019/0066896 A1 Feb. 28, 2019

Related U.S. Application Data

(63) Continuation of application No. PCT/EP2017/057730, filed on Mar. 31, 2017.

(30) Foreign Application Priority Data

Apr. 27, 2016 (DE) ..... 10 2016 107 818.2

(51) Int. Cl.
*H01F 30/16* (2006.01)
*H01F 27/32* (2006.01)
(Continued)

(52) U.S. Cl.
CPC ..... *H01F 17/062* (2013.01); *H01F 27/2828* (2013.01); *H01F 27/29* (2013.01);
(Continued)

(58) Field of Classification Search
CPC ..... H01F 17/062; H01F 27/292; H01F 27/29; H01F 27/324; H01F 30/16; H01F 27/2828; H01F 2005/046
See application file for complete search history.

(56) References Cited

U.S. PATENT DOCUMENTS 5,929,735 A * 7/1999 Heinrich ..... H01F 27/22 336/61
7,990,248 B2 * 8/2011 Feist ..... H01F 30/16 336/229

(Continued)

FOREIGN PATENT DOCUMENTS

DE 102010031292 A1 1/2012
DE 102013213404 A1 1/2015

(Continued)

OTHER PUBLICATIONS

International Search Report dated Jun. 27, 2017in connection with International Application PCT/EP2017/057730.

*Primary Examiner* — Tuyen T Nguyen
(74) *Attorney, Agent, or Firm* — Eschweiler & Potashnik, LLC

(57) ABSTRACT

A inductor arrangement has a toroidal core with a central opening, a winding which is arranged around the core and has two winding ends, and an electrically insulating insert which is inserted into the central opening in a clamping manner. Here, the winding ends are inserted into the insert in a clamping manner.

13 Claims, 5 Drawing Sheets

(51) Int. Cl.

| | |
|---|---|
| ***H01F 27/29*** | (2006.01) |
| ***H01F 17/06*** | (2006.01) |
| ***H01F 27/28*** | (2006.01) |
| *H01F 5/04* | (2006.01) |

(52) U.S. Cl.
CPC ..... *H01F 27/292* (2013.01); *H01F 27/32* (2013.01); *H01F 27/324* (2013.01); *H01F 30/16* (2013.01); *H01F 2005/046* (2013.01)

(56) References Cited

U.S. PATENT DOCUMENTS

| | | | | |
|---|---|---|---|---|
| 8,138,878 | B2 * | 3/2012 | Hundt | H01F 17/062 336/229 |
| 8,841,985 | B2 * | 9/2014 | Feist | H01F 41/125 336/229 |
| 2003/0151481 | A1 | 8/2003 | Kolarsky | |
| 2006/0192649 | A1 | 8/2006 | Feth | |
| 2008/0117009 | A1 * | 5/2008 | Feist | H01F 27/027 336/65 |
| 2008/0164968 | A1 | 7/2008 | Feist | |
| 2012/0228534 | A1 | 9/2012 | Kellner | |

FOREIGN PATENT DOCUMENTS

| | | | |
|---|---|---|---|
| EP | 2808879 | A1 | 12/2014 |
| JP | H09237717 | A | 9/1997 |

* cited by examiner

INDUCTOR ARRANGEMENT COMPRISING AN INSERT

CROSS REFERENCE TO RELATED APPLICATIONS

This application is a continuation of International Patent Application number PCT/EP2017/057730, filed on Mar. 31, 2017, which claims priority to German Patent Application number 10 2016 107 818.2, filed on Apr. 27, 2016, and is hereby incorporated by reference in its entirety.

FIELD

The disclosure relates to a inductor arrangement comprising an insert in its toroidal core. The insert serves to hold the ends of the winding, which is fitted onto the core, in a clamping manner.

BACKGROUND

Inductor arrangements are required in a large number of electrical devices, for example in filter arrangements. They are intended to be comparatively compact and at the same time intended to be simple and therefore cost-effective to manufacture.

Coil formers with insulation-displacement clamping apparatuses are known, for example from DE 100 14 738 A1. In said document, a coil wire is secured in a slot of slight depth by clamping, before the insulation-displacement clamping connection is established. A winding body for a magnet assembly having two electrical connection domes is likewise known from DE 10 2009 029 298 A1. The winding wire ends are fixed in clamping gaps and, after the winding process has taken place, separated from the rest of the winding wire by a wire cutting tool. One disadvantage of these known clamping arrangements is that they are projecting far beyond the dimensions of the coil former.

SUMMARY

The present disclosure discloses an inductor arrangement which has means for holding and insulating the winding ends and the associated connections, but remains compact with respect to its design in the process.

The inductor arrangement according to the disclosure has a toroidal core with a central opening into which an electrically insulating insert is inserted in a clamping manner. A winding with two winding ends is arranged around the core, wherein the winding ends are inserted into the insert in a clamping manner. The winding usually has a large number of turns of a winding wire which is wound around the core. Owing to the insert which is positioned in the central opening, the inductor arrangement has a compact design and at the same time holding of the winding ends in the electrically insulating insert in clamping manner provides the necessary electrical insulation of the winding ends.

In an advantageous embodiment of the inductor arrangement according to the disclosure, the two winding ends are inserted on mutually opposite sides of the insert. In a further advantageous embodiment of the inductor arrangement according to the disclosure, the two winding ends are inserted on the same side of the insert. One of the embodiments may be more advantageous depending on the desired further processing or assembly of the inductor arrangement.

In a further advantageous embodiment of the inductor arrangement according to the disclosure, the two winding ends are electrically connected to a connection wire in each case. That section of the respective winding end which is connected to the connection wire is inserted into the insert in order to be held there in a clamping manner. The electrical connection of the winding ends and the connection wires can be established, for example, by a soldering process. Holding of the connecting section in the electrically insulating insert in a clamping manner also provides the necessary electrical insulation of the winding ends and, respectively, connection wires in relation to one another. As a result, additional insulation which would otherwise have to be provided after connection of winding ends and connection wires has taken place is rendered superfluous. Production steps can be saved and therefore costs can be reduced.

In an advantageous embodiment of the inductor arrangement according to the disclosure, the winding is at an angle at the transition to the connecting section.

In a further advantageous embodiment of the inductor arrangement according to the disclosure, the insert is composed of a plastics material, the insert is, in one embodiment, manufactured in the form of an integral injection-molded part.

In a further advantageous embodiment of the inductor arrangement according to the disclosure, the insert has a lug with which a minimum distance between the winding ends is ensured. This lug can be located on the outer periphery of the insert and, together with holding of the insert in the central opening in a clamping manner, has the effect that the last turns in front of the two winding ends cannot move toward one another on the core. At the same time, rotation of the insert inside the central opening is countered.

In a further advantageous embodiment of the inductor arrangement according to the disclosure, the insert does not protrude out of the central opening beyond the winding, but rather is located completely inside the central opening. This results in a very compact design of the inductor arrangement.

DESCRIPTION OF THE FIGURES

The disclosure will be described below with reference to exemplary embodiments using drawings which, when considered together with the features of the claims, reveal further features, properties and advantages of the disclosure.

In the drawings.

DETAILED DESCRIPTION

Figure 1:
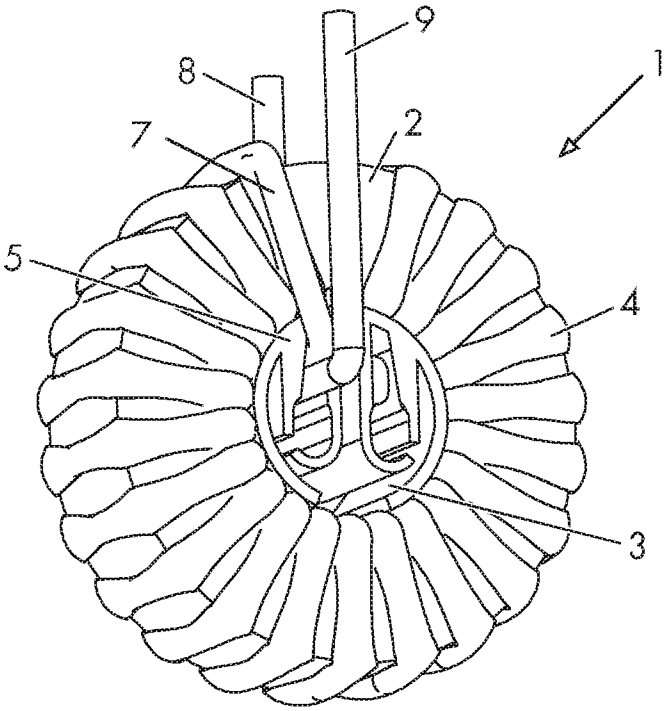
FIG. 1 shows an example embodiment of a inductor arrangement according to the disclosure.

FIG. 1 shows as example embodiment of a inductor arrangement 1 according to the disclosure comprising a toroidal core 2 and a central opening 3. The winding 4 has been wound onto the core 2 with a large number of turns. An insert 5 has been inserted into the central opening 3. In the relaxed state, not yet introduced, the spatial extent of the insert 5 is somewhat greater than the diameter of the central opening 3. When the insert 5 is inserted into the central opening 3, the insert 5 is compressed, so that it is then firmly held in the central opening 3 in a clamping manner. Connection wires 8, 9 protrude out of the housing 5, where they are connected to the winding ends 6, 7 (see FIG. 2). The slots of the insert 5 for receiving the connection wires 8, 9 and winding ends 6, 7 are spaced apart from one another in order to provide the creepage distances and clearance required for insulation.

Figure 2:
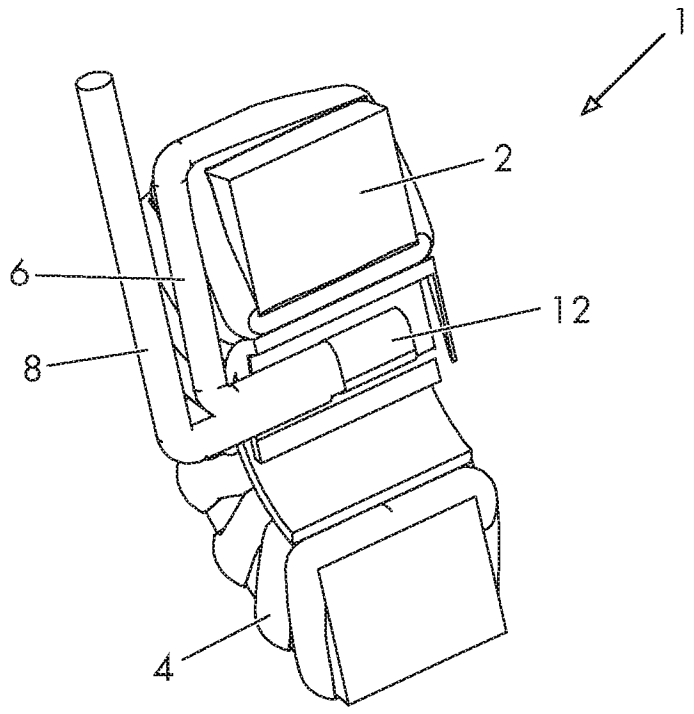
FIG. 2 shows a sectional view of the example embodiment according to FIG. 1, and FIGS. 3*a*-3*c* show example embodiments of an insert according to the disclosure.

FIG. 2 shows how a winding end 6 has been electrically connected to a connection wire 8 in a section 12, for example by soldering or pressing with a common metal sleeve. This section is then held in a clamping manner by insertion into one of the tapering slots 14, 15 (see FIG. 3) of the insert 5. Insert 5 has approximately the same or a lower thickness than the core 2, so that it does not protrude out of the central opening 3 beyond the winding 4. Note that the winding ends each comprise a first portion and a second portion, wherein the second portion forms a non-zero angle (e.g., a right angle) with respect to the first portion, and wherein the second portion of each winding end is inserted into the insert, and the first portion of each winding end is not inserted into the insert.

Figure 3A:
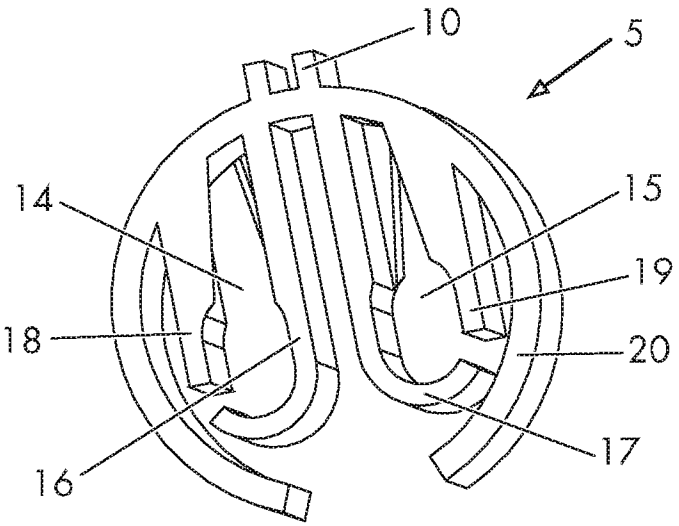

FIG. 3*a* shows an example embodiment of an insert 5 according to the disclosure. The insert 5 is manufactured from insulating material, for example in the form of an integral injection-molded part. The outer circumferential ring 20 of the insert 5 is not closed, so that the circumferential ring can be compressed and inserted into the central opening 3 of the inductor arrangement 1 according to the disclosure. After insertion into the central opening 3, the circumferential ring 20 expands again, so that the insert 5 is held in the central opening 3 in a clamping manner.

The insert 5 has two slots 14, 15 which taper in one direction. The slots 14, 15 are delimited by tabs 16-19. The section 12, in which for example connection wire 8 and winding end 6 are connected to one another, can be inserted in the wider opened part of one slot 14. This section 12 is then pushed into the tapering region of the slot 14. Analogously, the connection wire 9 and the winding end 7 are connected to one another and pushed into the tapering region of the slot 15 (not shown). At least one of the tabs 16, 18 has sharp edges in the tapering region of one slot 14, so that the section 12 can be secured in a desired position. The section 12 is then held between the edges of the tabs 16, 18 in a clamping manner. The spacing of the tabs 16, 17 results in a minimum distance between the sections 12 of the two winding ends 6, 7 and therefore also between the two connection wires 8, 9, the creepage and clearance distances required for insulation being provided in this way.

Furthermore, the insert 5 has at least one lug 10, in the example there are two. Said lugs, together with holding of the insert 5 in a clamping manner, have the effect that the first turn (for example that at winding end 6) and the last turn (at winding end 7) cannot move toward one another on the core 2, but rather maintain a minimum distance.

Figure 3B:
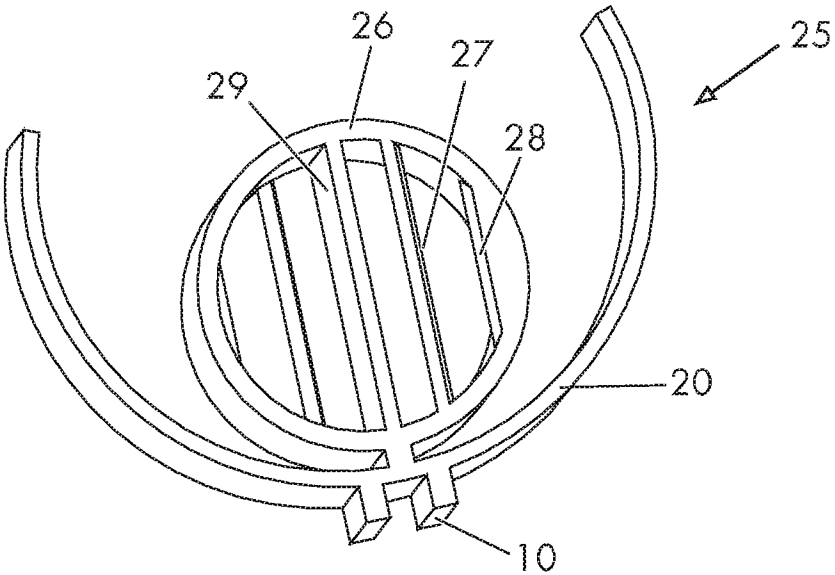

FIG. 3*b* shows a further advantageous embodiment of an insert 25 according to the disclosure. The outer circumferential ring 20 is of similar design to that in FIG. 3*a*; the clamping structures are different. A rigid inner supporting ring 26 with a likewise rigid bar 29 has, in its interior, sharp edges 28 and elastic bars 27. Sharp edges can likewise be formed on this elastic bar 27, so that, between the sharp edges 28 and 27, the connection wires 8, 9 and, respectively, winding ends 6, 7 which are connected to one another can be secured in a desired position in their section 12, but at the same time can be separated from one another, and therefore insulated, by the rigid bar 29.

Figure 3C:
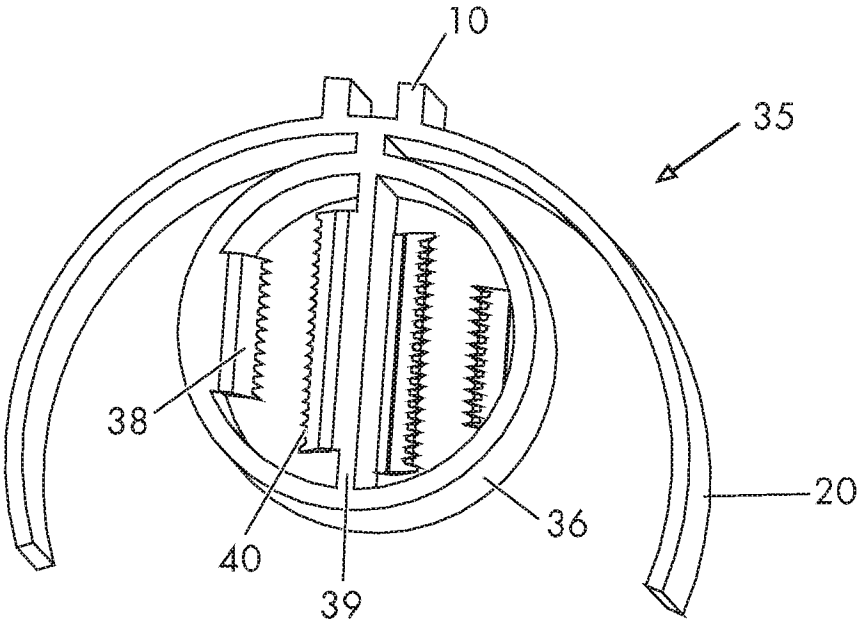

FIG. 3*c* shows a further advantageous embodiment of an insert 35 according to the disclosure. In this case too, the outer circumferential ring 20 is of similar design to that in FIGS. 3*a*-3*b*. A rigid inner supporting ring 36 with a bar 39 is equipped with edges 38, 40 of elastic design. The edges 38, 40 are equipped with corrugations in order to improve the clamping effect. The connection wires 6, 7 and winding ends 8, 9 which are connected to one another can be easily inserted between these edges 38, 40 in one direction, for example, from front to rear in the left-hand side of the figure, and clamped there.

The invention claimed is:

1. An inductor arrangement, comprising:

a toroidal core with a central opening, a winding arranged around the toroidal core and comprising two winding ends, and an electrically insulating insert which is inserted into the central opening in a clamping manner, wherein the electrically insulating insert has an outer surface that faces the toroidal core, and wherein a portion of the winding is disposed between the outer surface of the electrically insulating insert and the toroidal core, wherein the winding ends are inserted into the electrically insulating insert in a clamping manner, wherein the electrically insulating insert has a protrusion that protrudes outwardly from the outer surface of the electrically insulating insert toward an inner surface of the toroidal core, and wherein the protrusion separates the winding ends by a distance.

2. The inductor arrangement as claimed in claim 1, wherein a central axis extends through the central opening in a first direction and a second direction opposite the first direction, wherein the electrically insulating insert has a first side facing the first direction, and a second, opposite side facing the second direction, and wherein one of the winding ends is inserted into the electrically insulating insert from the first side and the other of the winding ends is inserted into the electrically insulating insert from the second side such that the two winding ends are inserted on mutually opposite sides of the electrically insulating insert.

3. The inductor arrangement as claimed in claim 1, wherein a central axis extends through the central opening in a first direction and a second direction opposite the first direction, wherein the electrically insulating insert has a first side facing the first direction, and a second, opposite side facing the second direction, and wherein both of the winding ends are inserted into the electrically insulating insert from one of the first or second sides of the electrically insulating insert such that the two winding ends are inserted on the same side of the electrically insulating insert.

4. The inductor arrangement as claimed in claim 1, wherein one connection wire is electrically connected to each of the two winding ends, respectively, in a section of the winding ends which is inserted into the electrically insulating insert.

5. The inductor arrangement as claimed in claim 1, wherein the winding ends each comprise a first portion and a second portion, wherein the second portion forms a non-zero angle with respect to the first portion, and wherein the second portion of each winding end is inserted into the electrically insulating insert, and the first portion of each winding end is not inserted into the electrically insulating insert.

6. The inductor arrangement as claimed in claim 1, wherein the electrically insulating insert comprises an integral injection-molded plastic part.

7. The inductor arrangement as claimed in claim 1, wherein the electrically insulating insert does not protrude out of the central opening beyond the winding.

8. The inductor arrangement as claimed in claim 1, wherein the outer surface of the electrically insulating insert faces the toroidal core and extends along the winding between the winding and a center of the central opening.

9. The inductor arrangement as claimed in claim 1, wherein the inner surface of the toroidal core faces the electrically insulating insert, and wherein the portion of the winding is disposed between the inner surface of the toroidal core and the outer surface of the electrically insulating insert.

10. The inductor arrangement as claimed in claim 9, wherein the portion of the winding separates the outer surface of the electrically insulating insert from the inner surface of the toroidal core.

11. An inductor arrangement, comprising:

a toroidal core with a central opening, a winding arranged around the toroidal core and comprising two winding ends, and an electrically insulating insert which is inserted into the central opening in a clamping manner, wherein the electrically insulating insert has an outer surface that faces the toroidal core, and wherein a portion of the winding is disposed between the outer surface of the electrically insulating insert and the toroidal core, wherein the winding ends are inserted into the electrically insulating insert in a clamping manner, wherein the electrically insulating insert comprises an outer ring, a first pair of tabs, and a second pair of tabs, wherein the first pair of tabs extend in a first direction from the outer ring toward a center of the central opening, and wherein the second pair of tabs extend adjacent to the first pair of tabs in the first direction from the outer ring toward the center of the central opening.

12. The inductor arrangement as claimed in claim 11, wherein a first tab of the first pair of tabs is hook-shaped.

13. An inductor arrangement, comprising:

a toroidal core with a central opening, a winding arranged around the toroidal core and comprising two winding ends, and an electrically insulating insert which is inserted into the central opening in a clamping manner, wherein the electrically insulating insert has an outer surface that faces the toroidal core, and wherein a portion of the winding is disposed between the outer surface of the electrically insulating insert and the toroidal core, wherein the winding ends are inserted into the electrically insulating insert in a clamping manner, wherein the electrically insulating insert comprises a pair of tabs and an outer ring with a gap therein, wherein the pair of tabs protrude from a section of the outer ring, which is opposite the gap in the outer ring, toward the gap in the outer ring.

* * * * *